US005388758A

United States Patent [19]

Scovell

[11] Patent Number: 5,388,758

[45] Date of Patent: Feb. 14, 1995

[54] ANTIBUCKLING CLAMSHELL PACKAGE

[75] Inventor: Daniel B. Scovell, Budd Lake, N.J.

[73] Assignee: International Paper Company, Purchase, N.Y.

[21] Appl. No.: 170,845

[22] Filed: Dec. 21, 1993

[51] Int. Cl.[6] ..... B65D 5/66

[52] U.S. Cl. ..... 229/146; 229/114; 229/920; 229/930

[58] Field of Search ..... 229/114, 145, 146, 902, 229/901, 920, 930

[56] References Cited

U.S. PATENT DOCUMENTS

| | | | |
|---|---|---|---|
| 1,839,752 | 1/1932 | Fogg . | |
| 2,247,870 | 7/1941 | Chalmers . | |
| 2,934,252 | 4/1960 | Wickstrom . | |
| 4,232,816 | 11/1980 | Johnson . | |
| 4,266,713 | 11/1981 | Maroszek . | |
| 4,301,960 | 11/1981 | Alexander . | |
| 4,431,128 | 2/1984 | Dirico . | |
| 4,792,085 | 12/1988 | Waring . | |
| 4,877,178 | 10/1989 | Eisman | 229/114 |
| 4,955,527 | 9/1990 | Blackman et al. | 229/114 |
| 5,039,003 | 8/1991 | Gordon . | |
| 5,090,571 | 2/1992 | Walker . | |
| 5,205,476 | 4/1993 | Sorenson | 229/114 |
| 5,221,040 | 6/1993 | Sorenson . | |

*Primary Examiner*—Gary E. Elkins

*Attorney, Agent, or Firm*—Michael J. Doyle; Paul R. Juhasz

[57] ABSTRACT

A clamshell type container formed of a unitary blank of paperboard. The rear wall of the container includes a hinge line to permit opening and closing of the top cover. Buckling sometimes occurs at this hinge line upon cover opening. According to this invention four curved cut lines are provided in the common rear wall having the hinge line. The ends of these cut lines are pairwise contiguous and are spaced only slightly apart. The four pairs of contiguous cut line ends form the corners of an imaginary rectangle. Two opposite corners of the rectangle lie on the hinge line, while the remaining two opposite corners lie laterally of the hinge line on respective opposite sides thereof.

10 Claims, 2 Drawing Sheets

ANTIBUCKLING CLAMSHELL PACKAGE

BACKGROUND OF THE INVENTION

This invention relates to a container and more particularly to a clamshell container of the type defined by a top cover and a bottom tray, with the front and sides of the top cover extending down over the top of the upper tray periphery, and with the top cover and bottom tray being hinged together by means of a hinge line in a common rear wall.

Clamshell type cartons or packages are known, as may be seen by reference to U.S. Pat. No. 4,232,816 issued to Johnson.

Clamshell type packages are popular in the fast food industry and may be fashioned from a unitary blank of paperboard or from molded plastic. When a clamshell type container is fashioned from a unitary blank of paperboard, there often exists the tendency for the rear hinge line or fold line which joins the top cover to the bottom tray to buckle upon opening. The art is aware of constructions to inhibit or lessen the effect of such buckling, as may be seen by U.S. Pat. No. 5,221,040 issued to Sorenson as well as the Johnson patent. In spite of these attempts to prevent buckling when the top cover is opened, there still exists a need for a simple and reliable anti-buckling construction for a clamshell type carton fashioned from a unitary blank of paperboard or other stiff, foldable and resilient sheet material.

SUMMARY OF THE INVENTION

According to the practice of this invention, a clamshell type carton fashioned from a unitary blank of paperboard is provided with a novel cut line configuration near the central portion of the rear hinge line which joins the top cover and the bottom tray. This novel cut configuration is defined by four arcuate concave cuts, with the ends of each cut terminating near or at the corners of an imaginary rectangle. Two opposite corners of this imaginary rectangle lie on the hinge line, while the remaining two opposite corners of the imaginary rectangle lie on opposite sides of the hinge line. Corresponding ends or termini of adjacent cuts are spaced from each other, typically about 1/32 of an inch, to thereby yield four necks which join the area enclosed by the four concave cut lines to the remaining portions of the rear wall of the container. This construction yields a clamshell carton which does not buckle at its rear wall when opened.

DETAILED DESCRIPTION OF THE INVENTION

Figure 1:
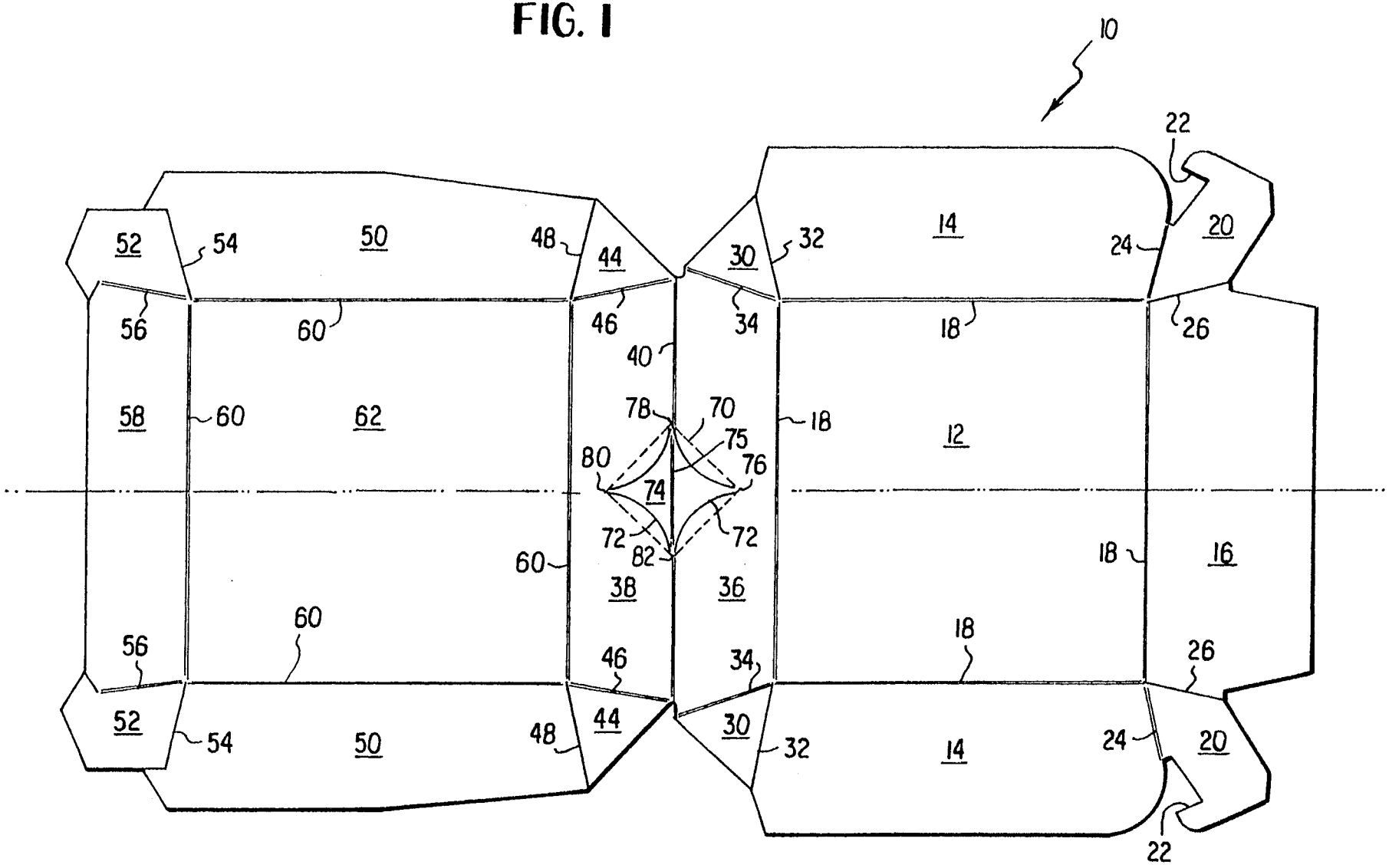
FIG. 1 is a plan view of a unitary blank of paperboard from which the clamshell container of this invention is formed.

Referring now to FIG. 1 of the drawings, a unitary blank of paperboard from which the container of this invention is fashioned is denoted as 10. The blank is typically die cut. The top cover portion of the blank includes a top cover panel 12, two side panels 14 and a front flap 16. Hook forming panels 20 are located adjacent the upper and lower portions of panel 16, being separated from panel 16 by cut lines 26. Hook panels 20 are foldably secured to side panels 14 by fold lines 24. The area of top cover 12 is defined by and bordered by fold lines 18. Web panels 30 are separated from the left ends of panels 14 by cut lines 32, with panels 30 being bordered by fold lines 34, the latter positioned at the upper and lower portions of rear wall 36 of the top cover. Rear wall 38 of the bottom tray is foldably secured to panel 36 by hinge line 40. Panels 36 and 38 define a common rear wall which joins the lower tray to the upper cover of the clamshell container formed from blank 10.

Each of triangular web panels 44 is bordered at the upper and lower portions of panel 38 by a respective fold line 46, with other portions of triangular webs 44 bordered by cut lines 48, the latter separating web panels 44 from lower tray side wall panels 50. Lower tray front panels 52 are separated from respective left portions of lower sidewall panels 50 by cut lines 54, with panels 52 being bordered by respective fold lines 56 at the upper and lower portions of front tray wall panel 58. Thus, panels 52 are foldably secured to lower front panel 58, panels 44 are foldably secured to rear tray wall panel 38, panels 30 are foldably secured to panel 36, and each of panels 20 is foldably secured to a respective right end of panels 14.

The common rear wall defined by rear walls 36 and 38 is provided with four arcuate, concave cut lines 72, these cut lines substantially defining and substantially enclosing a star shaped area 74. Corresponding and adjacent termini of cut lines 72, forming adjacent terminal or end pairs, are denoted as 76, 78, 80 and 82, with pairs 78 and 82 lying adjacent to hinge line 40 and with pairs 76 and 78 located laterally on opposite sides of hinge line 40. Corresponding ends of cut lines 72 are spaced apart about 1/32 of an inch, for a blank 10 of about 12.35 inches in length and about 6.7 inches in maximum width. It is seen that slightly spaced end pairs 76, 78, 80, and 82 generally form the corners of an imaginary rectangle 70 denoted by dashed lines. Imaginary rectangle 70 could be a parallelogram within the scope of the invention. That portion of hinge line 40 which passes through star shaped area 74 is denoted as 75 and is a perforated line. Line 75 is defined by spaced cuts extending through the paperboard.

Figure 2:
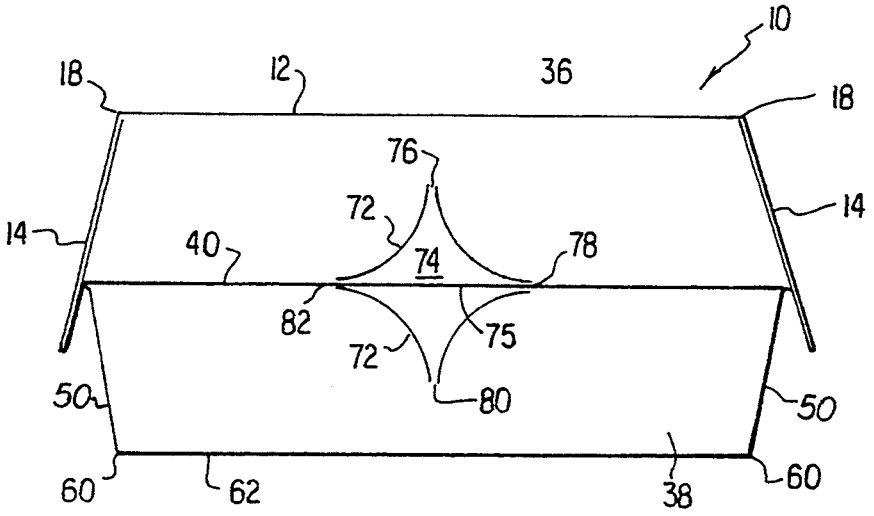
FIG. 2 is a rear elevational view of the clamshell container of this invention showing the configuration of four concave curved cut lines at the rear walls which serve to prevent buckling when the container is opened about its rear wall hinge line.

Referring now to FIG. 2 of the drawings, the end elevational view of the clamshell container also shows the common rear wall defined by rear walls 36 and 38. As is conventional, side flaps 14 pass downwardly beyond the upper edges of side tray walls 50, with common rear wall panel 36, 38 having hinge line 40 extending thereacross.

Figure 3:
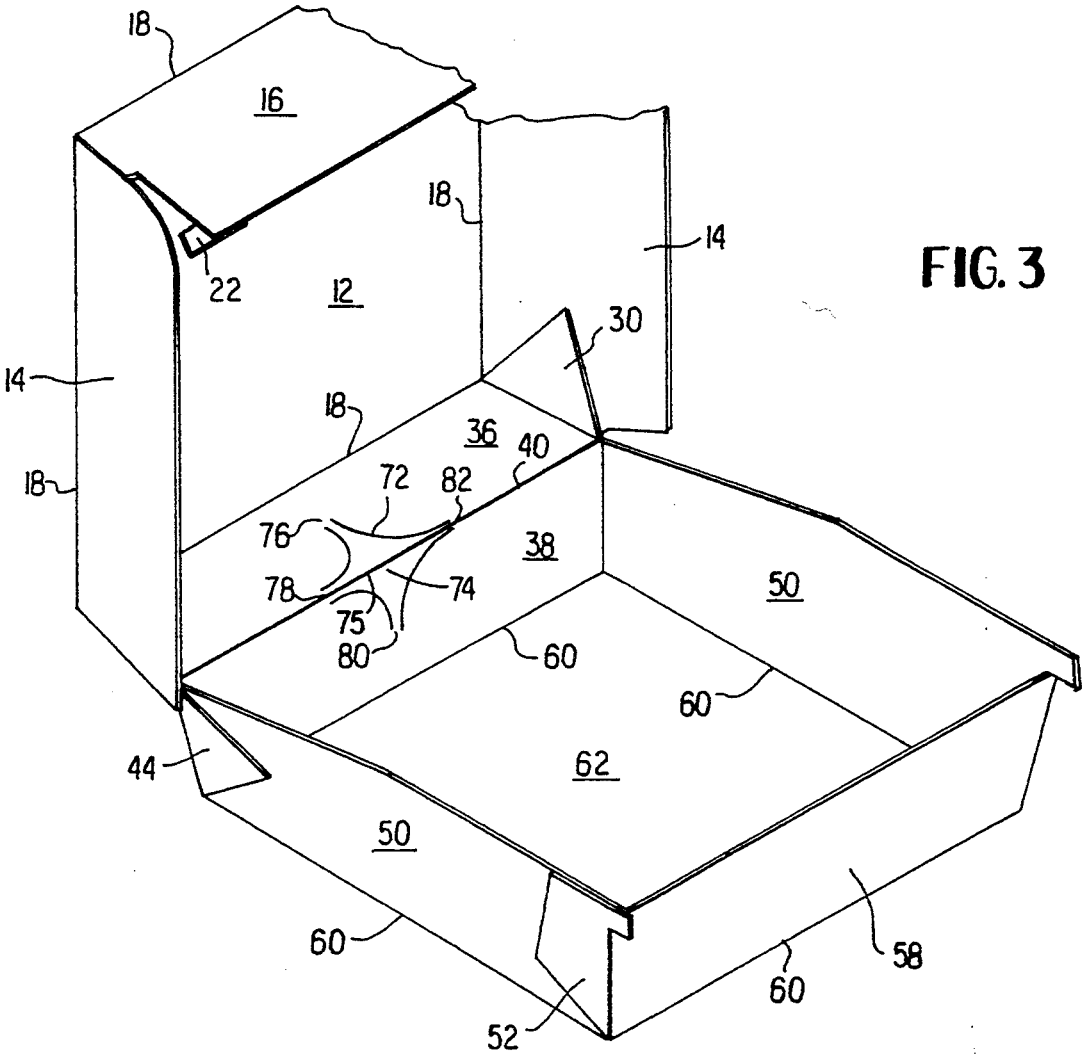
FIG. 3 is a perspective view of the clamshell type container of this invention and shows the four concave curved cut lines from the inside of the partially opened container.

Referring now to FIG. 3, the clamshell carton formed from the blank of FIG. 1 has been partially opened and the anti-buckling cut lines 72 are clearly seen. The star shaped area 74 remains with the container to thus preclude the loss of heat (as from a hamburger) from its interior.

It will be apparent that the number of sidewalls, while shown as four, could be of any number at least three, and that the specific form of the cover and tray is not limited to that of a four sided, truncated pyramid. Geometrical terms of orientation such as lower and upper are employed to facilitate the description and are not intended as limiting.

I claim:

1. A clamshell container formed from a unitary paperboard blank, the container having a cover and a lower tray, said cover and said tray each having a top wall and three or more sidewalls, a first of said sidewalls of said cover and said tray each forming a rear wall, said cover rear wall and said tray rear wall being integral with each other to define a common rear panel and being hingedly connected to each other by a hinge line, said hinge line extending across the container, four arcuate cut lines each extending through said rear panel, said four arcuate cut lines forming a generally star shaped area, each cut line having a terminal at each end of said cut line, the termini of said four cut lines generally defining four corners of an imaginary parallelogram, two opposite of said four corners of said imaginary parallelogram lying on said hinge line and two other opposite of said four corners of said imaginary parallelogram lying, respectively, on opposite sides of said hinge line, respective said termini spaced from each other to thereby form necks at tips of said star shaped area of said common rear panel.

2. The clamshell container of claim 1 wherein each of said four cut lines is of the same shape.

3. The container of claim 1 wherein said cover and said tray are each in the general form of a truncated, four sided pyramid.

4. The container of claim 1 wherein said imaginary parallelogram is an imaginary rectangle.

5. The blank of claim 1 wherein each of said four necks is of substantially the same width.

6. A unitary paperboard blank for forming a clamshell type container, the blank including a rear wall panel for the clamshell cover and a rear wall panel for the clamshell tray, said two rear wall panels coupled by a hinge line and forming a common rear wall panel, the improvement comprising, four arcuate cut lines in said common rear wall panel with each extending therethrough, each cut line having two ends, corresponding pairs of said cut line ends being contiguous to each other, said corresponding pairs of said cut line ends located at four corners of an imaginary parallelogram, two opposite of said four parallelogram corners lying on said hinge line and the remaining two opposite of said four parallelogram corners each located, respectively, laterally of said hinge line, said four arcuate cut lines forming a generally star shaped area having four narrow necks which join said generally star shaped area within said four arcuate cut lines to said common rear panel.

7. The blank of claim 6 wherein said imaginary parallelogram is an imaginary rectangle.

8. The blank of claim 6 wherein each of said four necks is of substantially the same width.

9. A clamshell container formed from a unitary paperboard blank, the container having a cover and a lower tray, said cover and said tray each having a top wall and three or more sidewalls, a first of said sidewalls of said cover and said tray each forming a rear wall, said cover rear wall and said tray rear wall being integral with each other to define a common rear panel and being hingedly connected to each other by a hinge line, said hinge line extending across the container, four separate cut lines each extending through said rear panel, each cut line having a terminal at each end of said cut line, the termini of said four cut lines generally defining corners of an imaginary parallelogram, two opposite of said corners of said imaginary parallelogram lying on said hinge line and two other opposite of said corners of said imaginary parallelogram lying, respectively, on opposite sides of said hinge line, said cut lines defining an area within said common rear panel, respective said termini at each of said corners of said imaginary parallelogram spaced from each other to thereby form four necks at tips at the area of said common rear panel enclosed by said four cut lines.

10. The clamshell container of claim 9 wherein each of said cut lines is concavely curved.

* * * * *